US012729856B2

(12) United States Patent
Kim et al.

(10) Patent No.: US 12,729,856 B2
(45) Date of Patent: Sep. 8, 2026

(54) COMBUSTION DEVICE COMPRISING ORTHOGONALLY ARRANGED CHANNELS

(71) Applicant: HANWHA AEROSPACE CO., LTD., Changwon-si (KR)

(72) Inventors: Shaun Kim, Changwon-si (KR); Ju Pyoung Kim, Changwon-si (KR); Seung Chai Jung, Changwon-si (KR); Hee Ho Park, Changwon-si (KR); Su Hyeong Cho, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 41 days.

(21) Appl. No.: 18/714,463

(22) PCT Filed: Jan. 17, 2022

(86) PCT No.: PCT/KR2022/000801
§ 371 (c)(1),
(2) Date: Nov. 12, 2024

(87) PCT Pub. No.: WO2023/113097
PCT Pub. Date: Jun. 22, 2023

(65) Prior Publication Data

US 2025/0354691 A1 Nov. 20, 2025

(30) Foreign Application Priority Data

Dec. 16, 2021 (KR) ..... 10-2021-0180857

(51) Int. Cl.
*F23R 3/34* (2006.01)
*F23R 3/04* (2006.01)
(Continued)

(52) U.S. Cl.
CPC ..... *F23R 3/343* (2013.01); *F23R 3/04* (2013.01); *F23R 3/283* (2013.01); *F23R 3/46* (2013.01)

(58) Field of Classification Search
CPC .. F23R 3/286; F23R 3/283; F23R 3/14; F23R 3/16; F23R 2900/00002; F23R 3/343;
(Continued)

(56) References Cited

U.S. PATENT DOCUMENTS 6,267,585 B1 * 7/2001 Suttrop ..... F23D 14/70 431/278
8,424,311 B2 4/2013 York et al.
(Continued)

FOREIGN PATENT DOCUMENTS

CA 2 950 558 C 10/2020
CN 101675228 A * 3/2010 ..... F23R 3/005
(Continued)

OTHER PUBLICATIONS

International Search Report (PCT/ISA/210) issued Sep. 2, 2022 by the International Searching Authority in International Patent Application No. PCT/KR2022/000801.
(Continued)

*Primary Examiner* — Craig Kim
(74) *Attorney, Agent, or Firm* — Sughrue Mion, PLLC

(57) ABSTRACT

The present invention relates to a combustion device. A combustion device according to one embodiment of the present invention comprises: a fuel manifold for distributing a fuel, which is flowing in, to one or more fuel inlet ports; a plurality of fuel channels receiving the fuel from the fuel manifold and having one or more fuel spray holes on one end; an air inflow duct disposed so as to surround the plurality of fuel channels; a combustion plate supporting one end of the respective fuel channels and having a plurality of
(Continued)

air channels for guiding the air flowing into the air inflow duct to a perpendicular direction to the fuel spraying direction of the fuel spray holes; and a combustion chamber disposed toward the combustion plate.

13 Claims, 14 Drawing Sheets

(51) Int. Cl.
*F23R 3/28* (2006.01)
*F23R 3/46* (2006.01)

(58) Field of Classification Search
CPC .... F23R 3/10; F23R 3/18; F23R 3/346; F23R 3/04; F23R 3/46
See application file for complete search history.

(56) References Cited

U.S. PATENT DOCUMENTS

| | | | | |
|---|---|---|---|---|
| 9,291,103 | B2 | 3/2016 | Belsom et al. | |
| 10,775,047 | B2 * | 9/2020 | Horikawa | F23R 3/10 |
| 11,079,113 | B2 | 8/2021 | Tada et al. | |
| 11,365,885 | B2 * | 6/2022 | Lin | F23R 3/14 |
| 11,867,400 | B1 * | 1/2024 | Hu | F23R 3/16 |
| 12,025,311 | B2 * | 7/2024 | Oskam | F02C 7/222 |
| 12,055,296 | B2 * | 8/2024 | Chon | F02C 7/222 |
| 12,416,408 | B2 * | 9/2025 | Benjamin | F23R 3/286 |
| 2004/0035114 | A1 * | 2/2004 | Hayashi | F23R 3/18 60/737 |
| 2004/0255589 | A1 * | 12/2004 | Yoshida | F23R 3/286 60/746 |
| 2009/0173075 | A1 * | 7/2009 | Miura | F23R 3/343 60/737 |
| 2010/0162711 | A1 | 7/2010 | Zuo et al. | |
| 2011/0076628 | A1 * | 3/2011 | Miura | F23R 3/343 431/12 |
| 2013/0219899 | A1 * | 8/2013 | Uhm | F23C 7/004 60/738 |
| 2013/0232979 | A1 * | 9/2013 | Singh | F23R 3/286 60/737 |
| 2014/0260271 | A1 * | 9/2014 | Keener | F23R 3/10 60/737 |
| 2015/0285148 | A1 * | 10/2015 | Lovett | F02C 7/22 60/734 |
| 2016/0040883 | A1 * | 2/2016 | Asai | F23R 3/10 60/737 |
| 2016/0290646 | A1 * | 10/2016 | Abe | F23R 3/04 |
| 2017/0074519 | A1 * | 3/2017 | Abe | F23R 3/10 |
| 2017/0082291 | A1 | 3/2017 | Horikawa et al. | |
| 2018/0363551 | A1 * | 12/2018 | Chila | F02C 7/222 |
| 2019/0277492 | A1 | 9/2019 | Karkow et al. | |
| 2020/0158020 | A1 * | 5/2020 | Yagi | F23R 3/346 |
| 2021/0102703 | A1 * | 4/2021 | Tada | F02C 7/22 |
| 2021/0285639 | A1 * | 9/2021 | Kumagai | F23R 3/286 |
| 2021/0325046 | A1 * | 10/2021 | Lin | F23R 3/286 |

FOREIGN PATENT DOCUMENTS

| | | | | |
|---|---|---|---|---|
| CN | 110741205 | A * | 1/2020 | F23R 3/00 |
| CN | 116241911 | A * | 6/2023 | F23R 3/286 |
| DE | 10 2009 059 222 | A1 | 7/2010 | |
| DE | 102020212361 | A1 * | 4/2021 | F23R 3/26 |
| EP | 1 843 099 | B1 | 9/2017 | |
| EP | 4379261 | A1 * | 6/2024 | F23D 11/383 |
| JP | 3830596 | B2 | 10/2006 | |
| JP | 2016-38108 | A | 3/2016 | |
| JP | 2017-522533 | A | 8/2017 | |
| JP | 2021-169913 | A | 10/2021 | |
| KR | 10-2190537 | B1 | 12/2020 | |
| WO | 2018/199289 | A1 | 11/2018 | |

OTHER PUBLICATIONS

Written Opinion (PCT/ISA/237) issued Sep. 2, 2022 by the International Searching Authority in International Patent Application No. PCT/KR2022/000801.
Communication dated Aug. 12, 2025, issued by European Patent Office in European Patent Application No. 22907570.0.

* cited by examiner

COMBUSTION DEVICE COMPRISING ORTHOGONALLY ARRANGED CHANNELS

CROSS-REFERENCE TO RELATED APPLICATIONS

This application is a National Phase Entry of PCT International Application No. PCT/KR2022/000801 filed on Jan. 17, 2022, which claims priority to Korean Patent Application No. 10-2021-0180857 filed on Dec. 16, 2021.

TECHNICAL FIELD

The present disclosure relates to combustion devices, and more specifically, to a combustion device including channels arranged orthogonally.

BACKGROUND ART

In general, aircraft engines or industrial gas turbines generate thrust or power by converting chemical energy stored in fuel into heat energy or kinetic energy. Most fuels contain hydrocarbons, and thus, carbon dioxide is inevitably generated during combustion. Recently, combustion devices using hydrogen gas have been attracting attention to suppress the generation of carbon dioxide, which is a greenhouse gas.

However, in a conventional hydrogen gas combustion device, fuel inlets are arranged in an annular shape, so an air hydraulic area per cross-sectional area of a combustion internal space is very small and pressure loss is large. Additionally, in the case of hydrogen gas combustion devices, carbon dioxide is not generated, but NOx is still generated in high temperature areas.

The technology disclosed in this Background section was already known to the inventors of the disclosure before achieving the disclosure or is technical information acquired in the process of achieving the disclosure. Therefore, it may contain technology that does not form the prior art that is already known in this country to a person of ordinary skill in the art.

DISCLOSURE

Technical Problem

Provided is a combustion device in which fuel channels and air channels are arranged orthogonally to increase a flame density and reduce generation of NOx.

However, these embodiments are exemplary, and embodiments of the present disclosure are not limited thereto.

Technical Solution

A combustion device according to an embodiment of the present disclosure includes a fuel manifold configured to distribute fuel flowing into one or more fuel inlets, a plurality of fuel channels configured to receive the fuel from the fuel manifold and including one or more fuel spraying holes in one end, an air inlet duct arranged to surround the plurality of fuel channels, a combustion plate configured to support one end of each of the fuel channels and including a plurality of air channels that guide air introduced into the air inlet duct in a direction perpendicular to a fuel spraying direction of the fuel spraying holes, and a combustion chamber disposed toward the combustion plate.

In the combustion device according to an embodiment of the present disclosure, the one or more fuel spraying holes may be disposed in a lateral surface of one end of the fuel channel, and the plurality of air channels may be holes or slits formed in the combustion plate to correspond to the plurality of fuel spraying holes.

In the combustion device according to an embodiment of the present disclosure, the combustion plate may be disposed more inward in a direction toward the fuel inlet than the fuel spraying hole.

In the combustion device according to an embodiment of the present disclosure, a plurality of fuel spraying holes may be disposed in a lateral surface of the fuel channel at regular intervals, and the plurality of air channels may be arranged in a cross shape to correspond to the plurality of fuel spraying holes.

In the combustion device according to an embodiment of the present disclosure, the one or more fuel inlets may include a main fuel inlet configured to supply main fuel to a plurality of main fuel channels among the plurality of fuel channels, and a pilot fuel inlet configured to supply pilot fuel to a plurality of pilot fuel channels among the plurality of fuel channels.

In the combustion device according to an embodiment of the present disclosure, the combustion plate may include a plurality of segments arranged in a first direction and a second direction perpendicular to the first direction, the plurality of main fuel channels may be respectively disposed at nodes where corners of the plurality of segments meet each other, and the plurality of pilot fuel channels may be disposed at respective centers of the segments.

In the combustion device according to an embodiment of the present disclosure, a fuel spraying hole of the main fuel channel and a fuel spraying hole of the pilot fuel channel may have different fuel spraying angles.

In the combustion device according to an embodiment of the present disclosure, a fuel spraying hole of the main fuel channel may be disposed such that a fuel spraying angle is inclined by 45 degrees with respect to a fuel spraying angle of a fuel spraying hole of the pilot fuel channel.

In the combustion device according to an embodiment of the present disclosure, the plurality of air channels may include a plurality of main air channels corresponding to fuel spraying holes of the main fuel channel, and a plurality of pilot air channels corresponding to fuel spraying holes of the pilot fuel channel, and an imaginary line extending through the plurality of main air channels and an imaginary line extending through the plurality of pilot air channels may intersect each other at an angle other than a right angle.

In the combustion device according to an embodiment of the present disclosure, the plurality of main fuel channels may not be arranged on the imaginary line extending through the plurality of pilot air channels, and the plurality of pilot fuel channels may be arranged on the imaginary line extending through the plurality of main air channels.

In the combustion device according to an embodiment of the present disclosure, the fuel manifold may include one or more fuel distribution guides configured to guide main fuel flowing in from the main fuel inlet and pilot fuel flowing in from the pilot fuel inlet to different paths, respectively, and one or more distribution plates including a plurality of fuel distribution holes for supplying the main fuel and the pilot fuel distributed along the fuel distribution guide to respective one ends of the plurality of main fuel channels and respective one ends of the plurality of pilot fuel channels.

In the combustion device according to an embodiment of the present disclosure, the one or more distribution plates may include a first distribution plate and a second distribution plate sequentially arranged in a movement direction of the fuel, and a pair of fuel distribution guides may be disposed on a front surface and a rear surface of the first distribution plate, respectively.

In the combustion device according to an embodiment of the present disclosure, the plurality of fuel distribution holes included in the first distribution plate and the plurality of fuel distribution holes included in the second distribution plate may be arranged so as not to overlap each other.

The combustion device according to an embodiment of the present disclosure may further include one or more air distribution plates disposed inside the air inlet duct to support the plurality of fuel channels, and including a plurality of air distribution holes.

A combustion device according to an embodiment of the present disclosure includes a plurality of fuel channels having a plurality of fuel spraying holes in one side, and a combustion plate including a plurality of air channels arranged to correspond to the fuel spraying holes to support respective one ends of the plurality of fuel channels and guide air perpendicularly with a fuel spraying angle of the fuel spraying holes. The plurality of fuel channels may include a plurality of pilot fuel channels supplying pilot fuel and a plurality of main fuel channels supplying main fuel, and a fuel spraying hole of the main fuel channel may be disposed such that a fuel spraying angle of the fuel spraying hole is inclined at a predetermined angle with respect to a fuel spraying angle of a fuel spraying hole of the pilot fuel channel.

These and/or other aspects will become apparent and more readily appreciated from the following description of the embodiments, taken in conjunction with the accompanying drawings.

Advantageous Effects

In a combustion device according to an embodiment of the present disclosure, main fuel channels and pilot fuel channels may be arranged to cross each other while supplying main fuel and pilot fuel separately, thereby increasing flame stability and reducing NOx emissions.

In the combustion device according to an embodiment of the present disclosure, the fuel spraying angle of the main fuel channels and the fuel injection angle of the pilot fuel channels may cross each other, while the main fuel channels and the pilot fuel channels are arranged at right angles, thereby minimizing interference between adjacent flames and increasing a flame density.

In the combustion device according to an embodiment of the present disclosure, the fuel spraying angle of fuel channels and the air inlet angle of air channels may be right angles, thereby increasing combustion efficiency, minimizing interference between adjacent flames, and increasing a flame density.

BEST MODE

Figure 1:
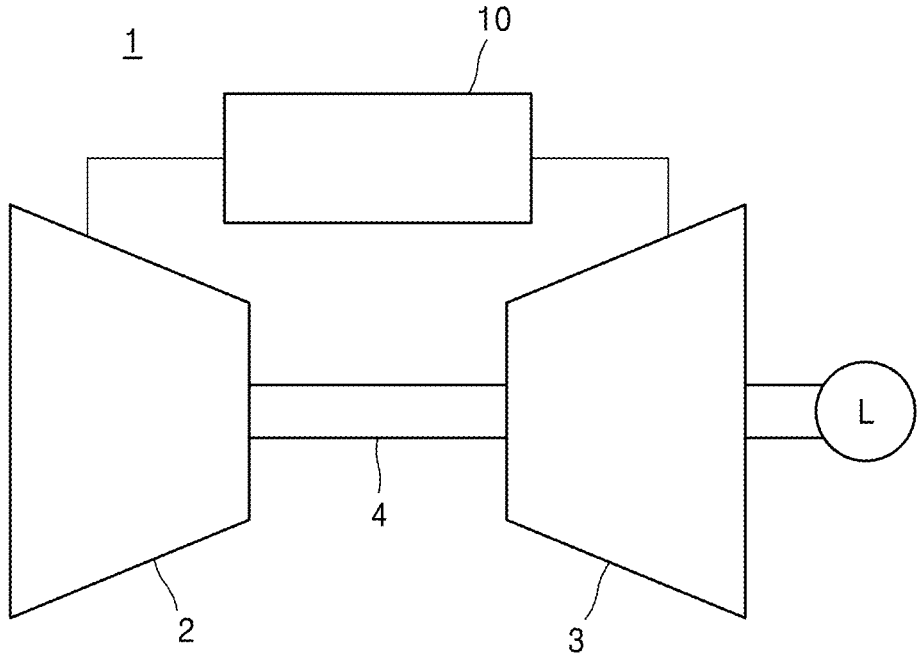
FIG. 1 shows a gas turbine engine according to an embodiment of the present disclosure.

A combustion device according to an embodiment of the present disclosure includes a fuel manifold configured to distribute fuel flowing into one or more fuel inlets, a plurality of fuel channels configured to receive fuel from the fuel manifold and including one or more fuel spraying holes on one end, an air inlet duct arranged to surround the plurality of fuel channels, a combustion plate configured to support one end of each of the fuel channels and including a plurality of air channels that guide air introduced into the air inlet duct perpendicularly with a fuel spraying direction of the fuel spraying holes, and a combustion chamber disposed toward the combustion plate.

Mode for Invention

As the disclosure allows for various changes and numerous embodiments, particular embodiments will be illustrated in the drawings and described in detail in the written description. However, this is not intended to limit the disclosure to particular embodiments, and it is to be appreciated that all changes, equivalents, and substitutes that do not depart from the spirit and technical scope of the disclosure are encompassed in the disclosure. In the description of the disclosure, even though shown in other embodiments, the same reference characters or numerals are used for the same components.

Hereinafter, the disclosure will be described in detail by explaining exemplary embodiments of the disclosure with reference to the attached drawings. Like reference numerals in the drawings denote like components, and thus their description will be omitted.

It will be understood that although the terms "first," "second," etc. may be used herein to describe various components, these components should not be limited by these terms. These components are only used to distinguish one component from another.

As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

Sizes of components in the drawings may be exaggerated for convenience of explanation. In other words, since sizes and thicknesses of components in the drawings are arbitrarily illustrated for convenience of explanation, the following embodiments are not limited thereto.

In the following embodiments, an x-axis, a y-axis, and a z-axis are not limited to the three axes of an orthogonal coordinate system, and may be interpreted in a broader sense. For example, the x-axis, y-axis, and z-axis may be orthogonal to each other, but may refer to different directions that are not orthogonal to each other.

When a certain embodiment may be implemented differently, a specific process order may be performed differently from the described order. For example, two consecutively described processes may be performed substantially at the same time or performed in an order opposite to the described order.

The terms used in the present specification are merely used to describe particular embodiments, and are not intended to limit the disclosure. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Figure 2:
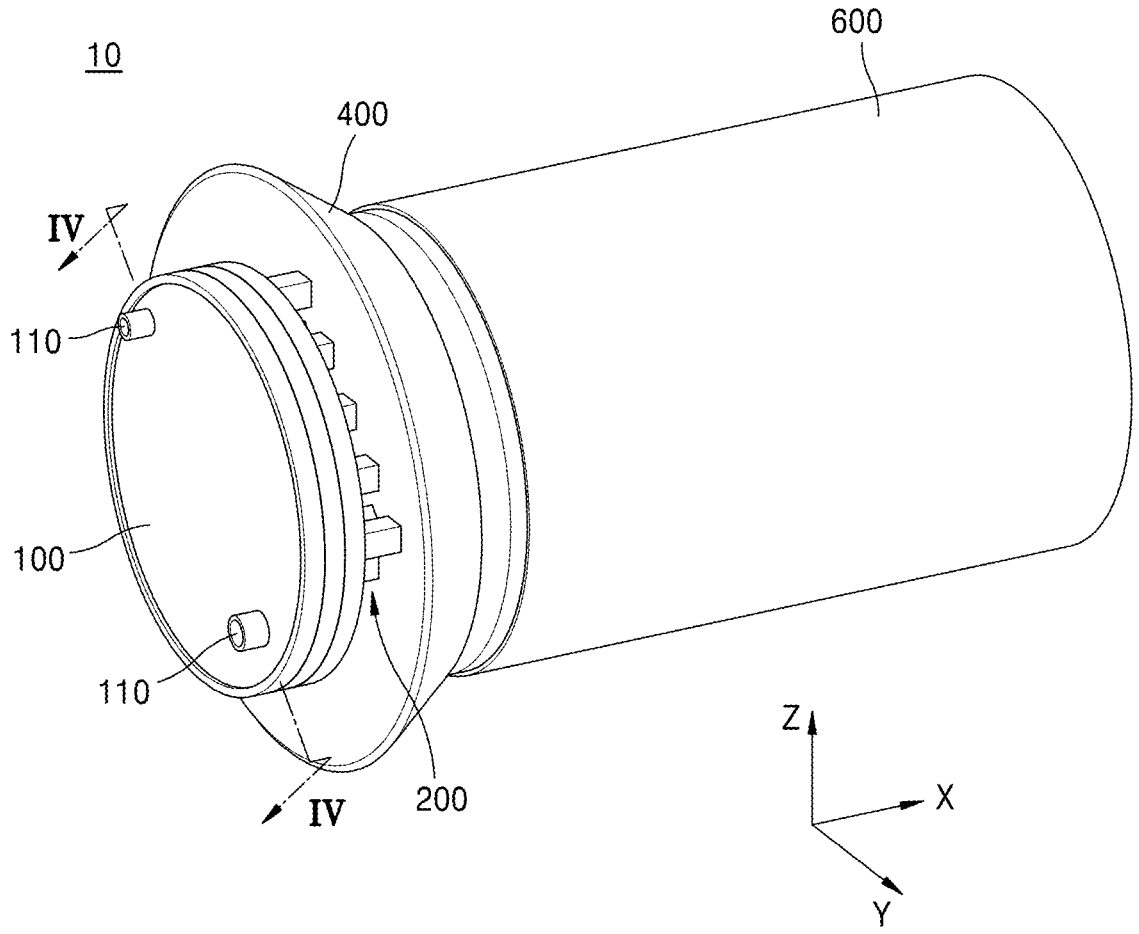
FIG. 2 shows a combustion device according to an embodiment of the present disclosure.
Figure 3:
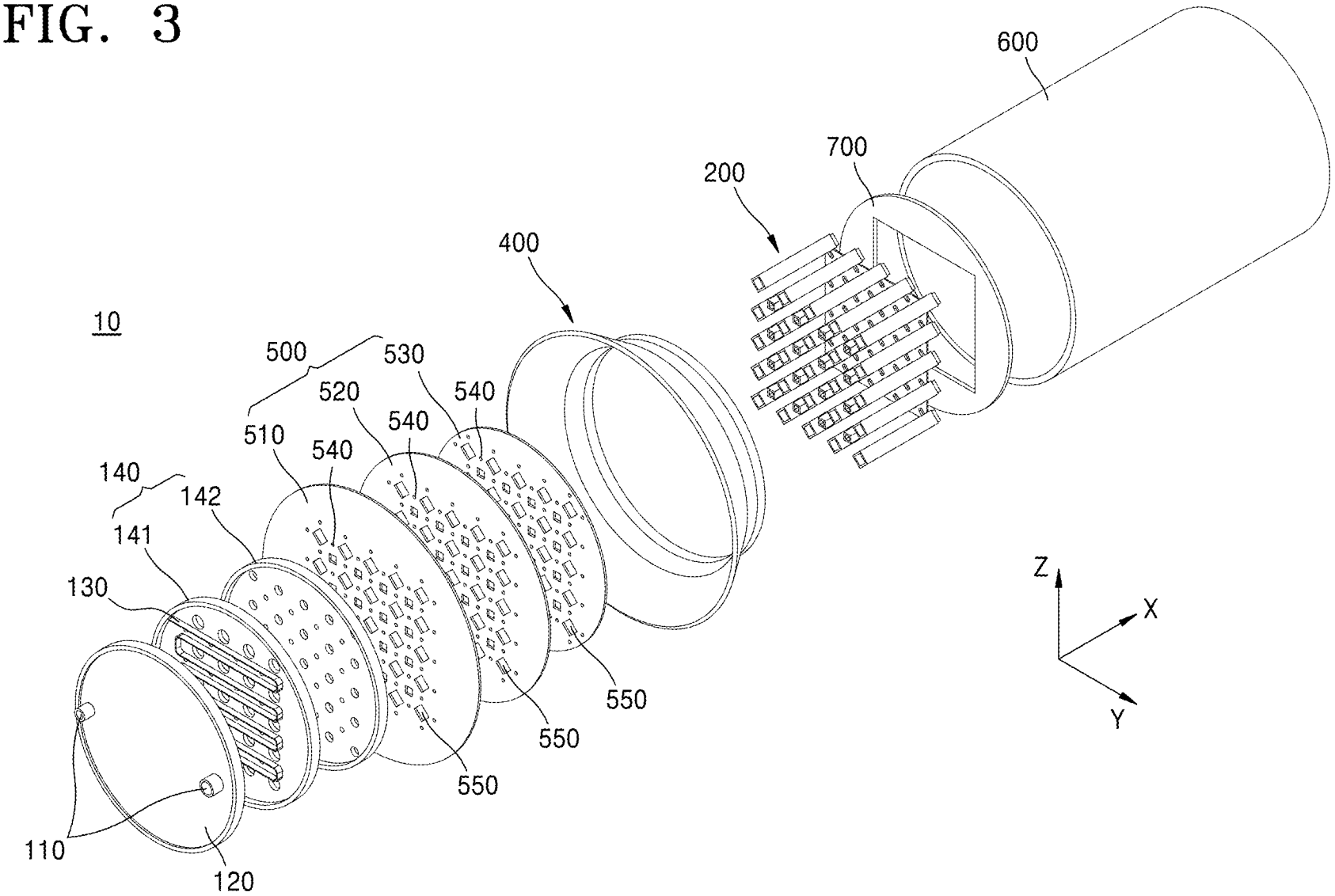
FIG. 3 is an exploded perspective view of a combustion device according to an embodiment of the present disclosure.
Figure 4:
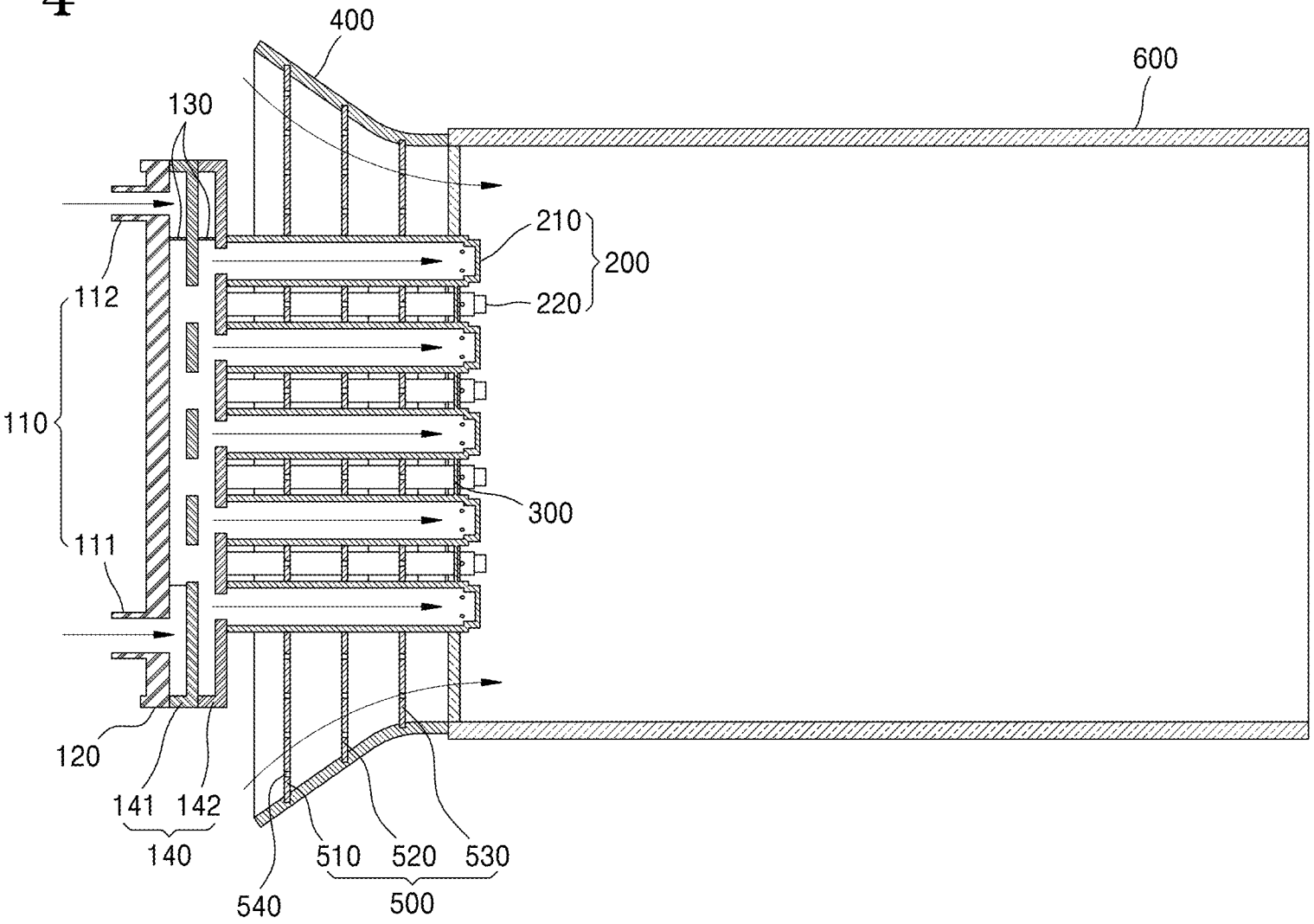
FIG. 4 is a cross-section taken along line IV-IV of FIG. 2.
Figure 5:
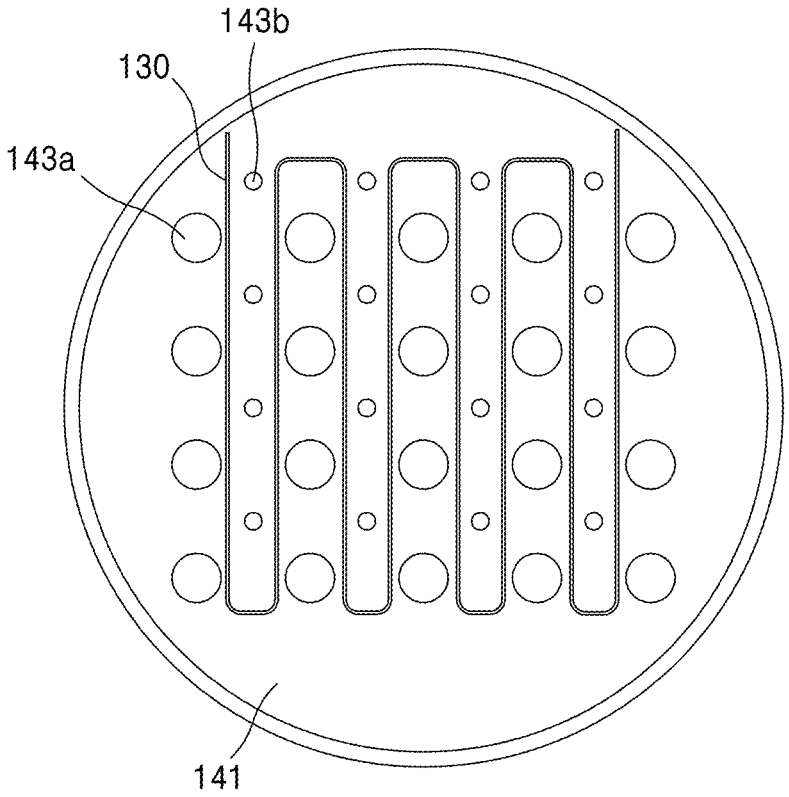
FIGS. 5 and 6 show a fuel distribution guide and a distribution plate according to an embodiment of the present disclosure.
Figure 6:
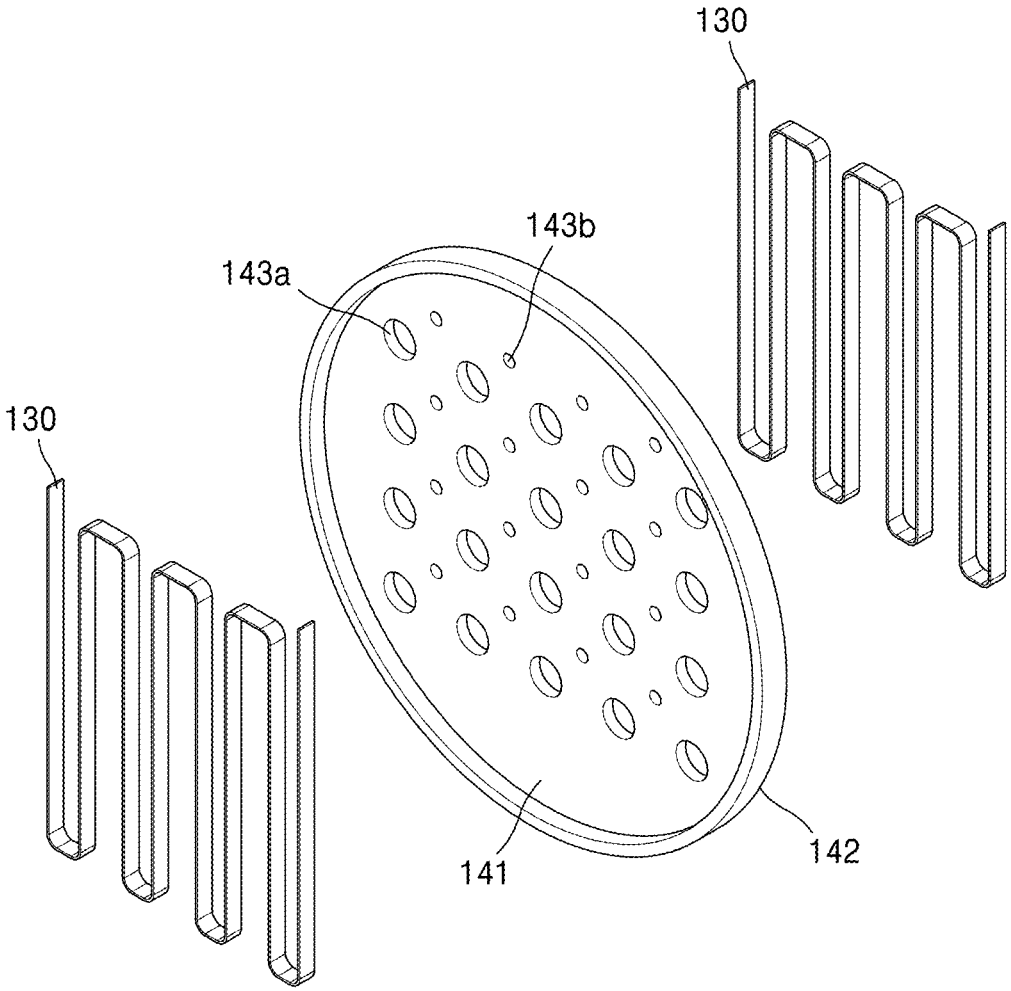
Figure 7:
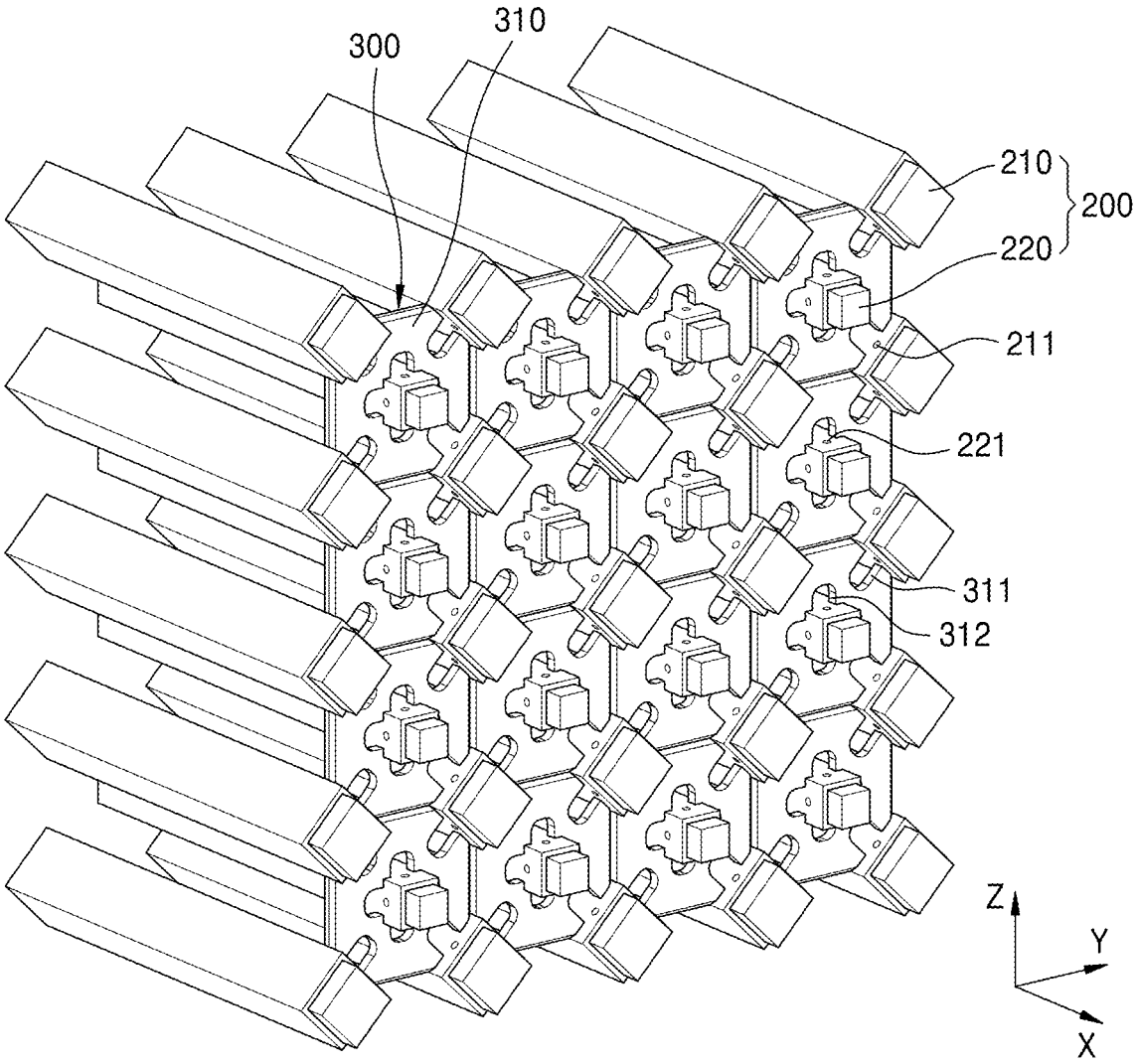
FIGS. 7, 8 and 9 show a fuel channel and a combustion plate according to an embodiment of the present disclosure.
Figure 8:
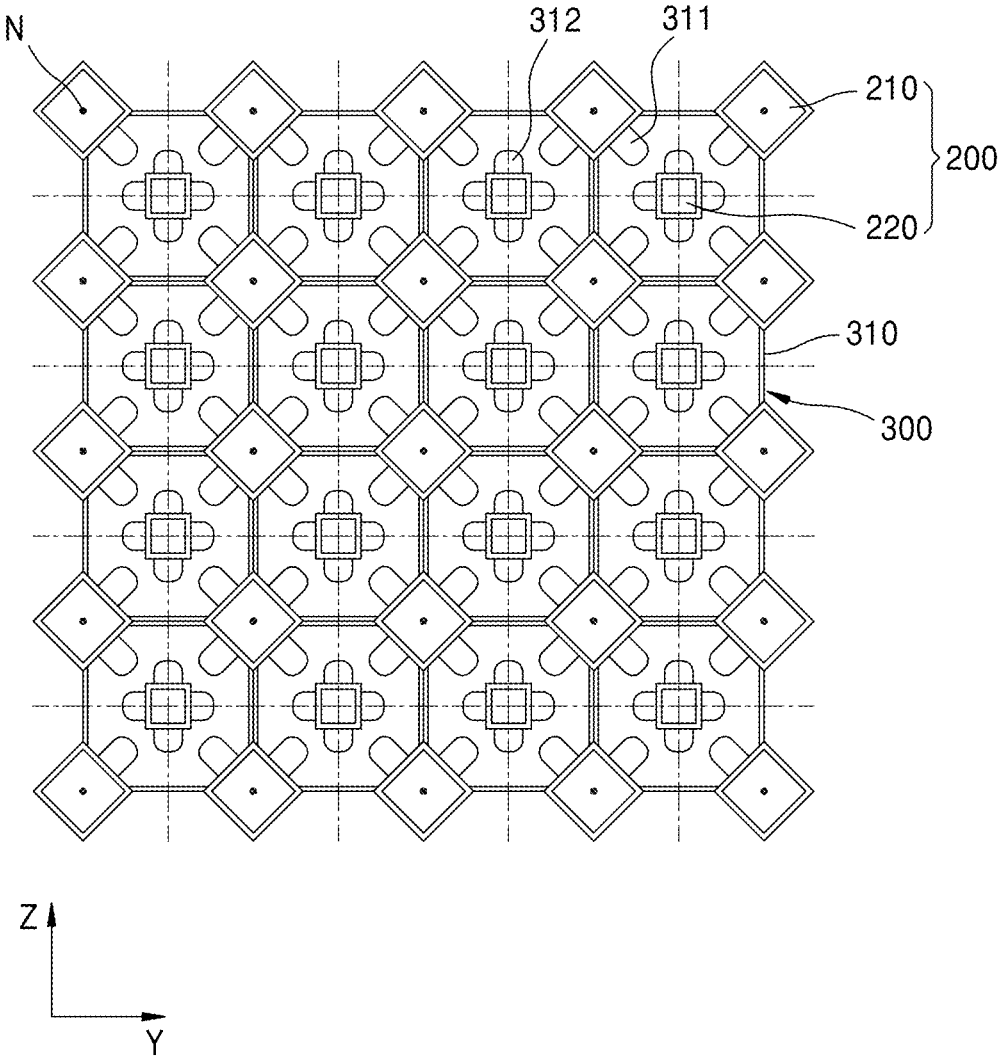
Figure 9:
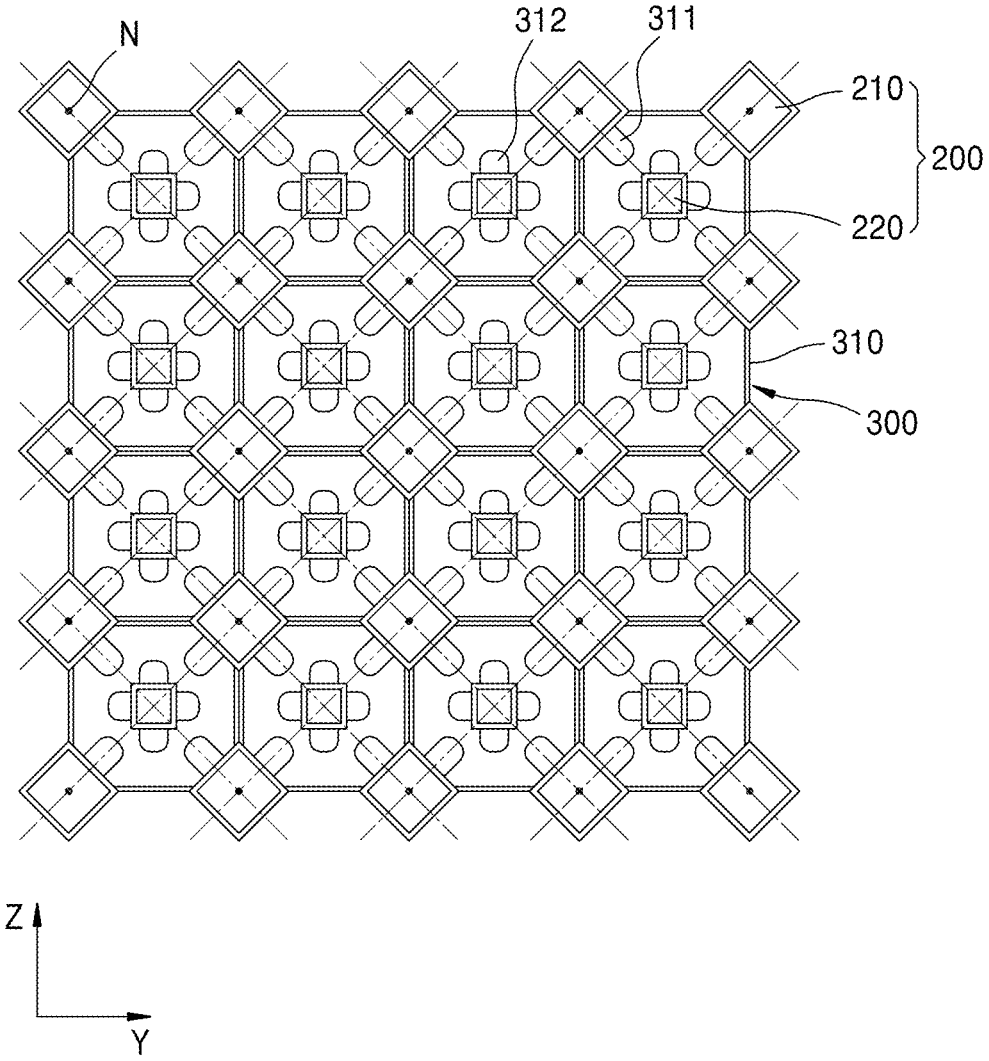
Figure 10:
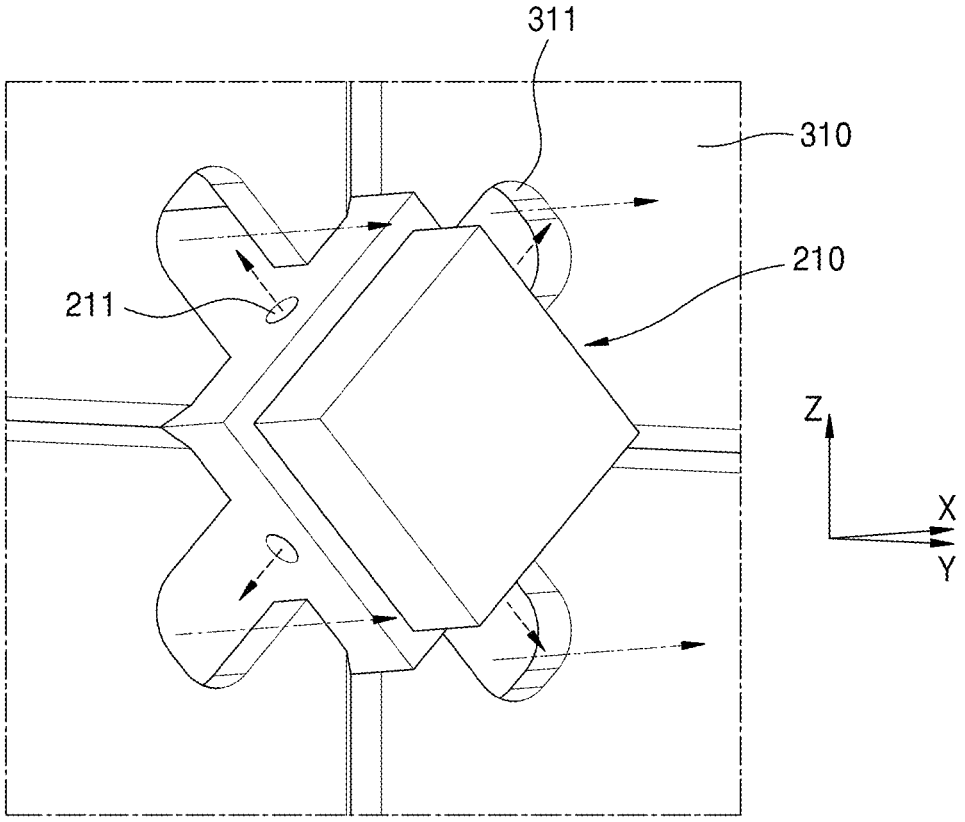
FIG. 10 shows a main fuel channel and a main air channel according to an embodiment of the present disclosure.
Figure 11:
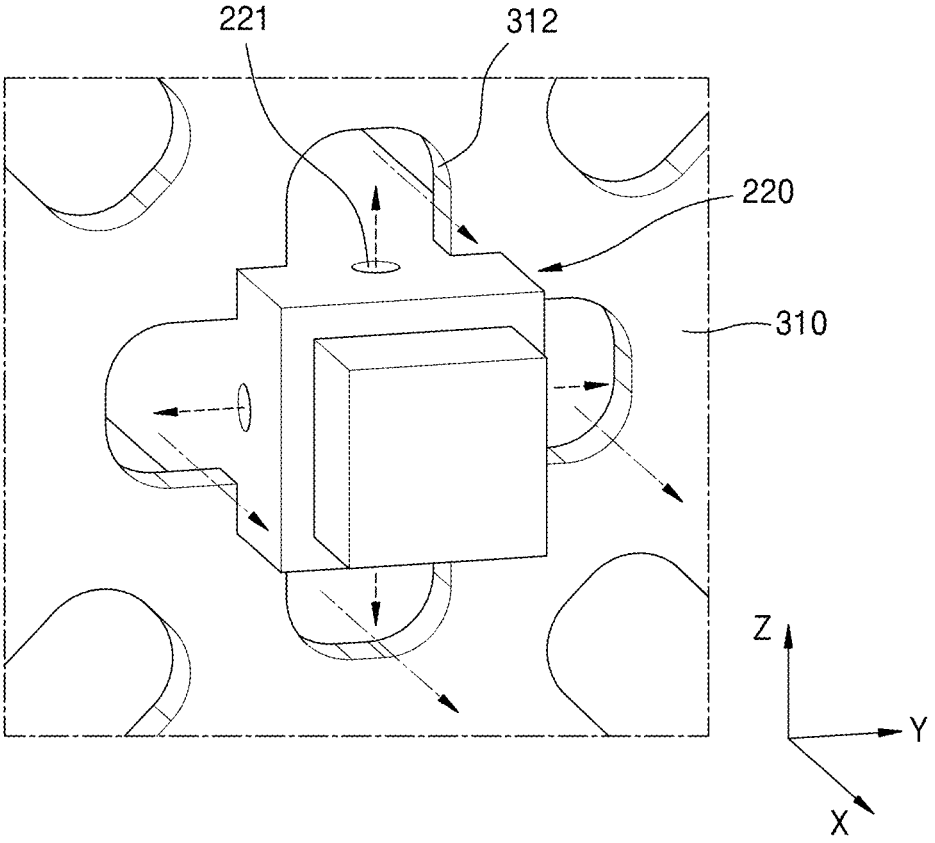
FIG. 11 shows a pilot fuel channel and a pilot air channel according to an embodiment of the present disclosure.
Figure 12:
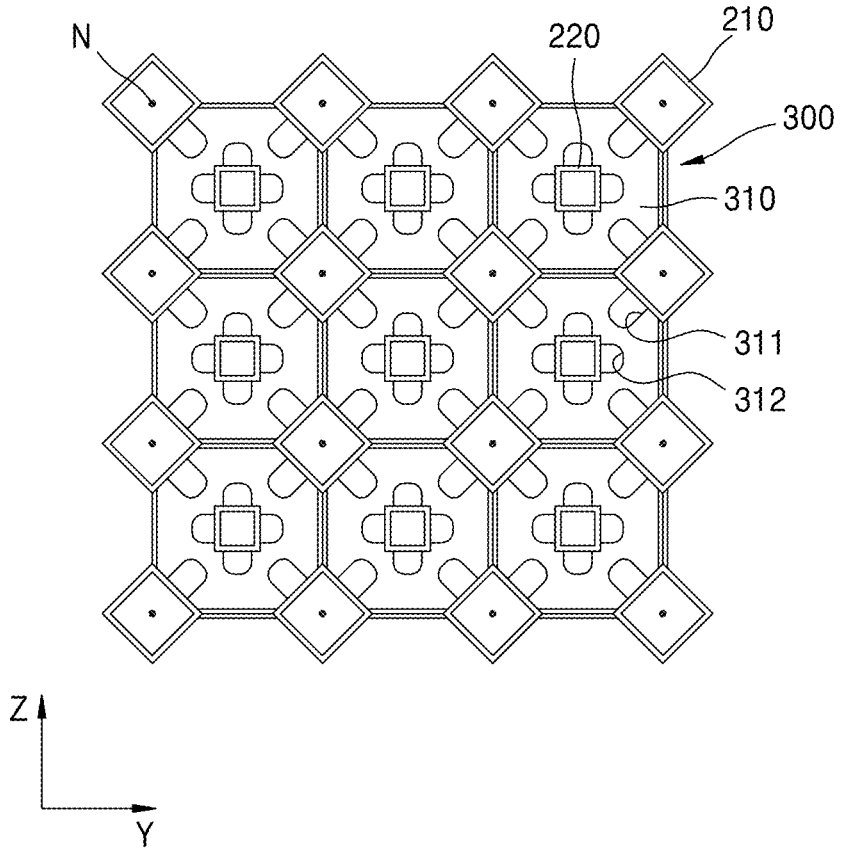
FIGS. 12 and 13 show a fuel channel and a combustion plate according to an embodiment of the present disclosure.
Figure 13:
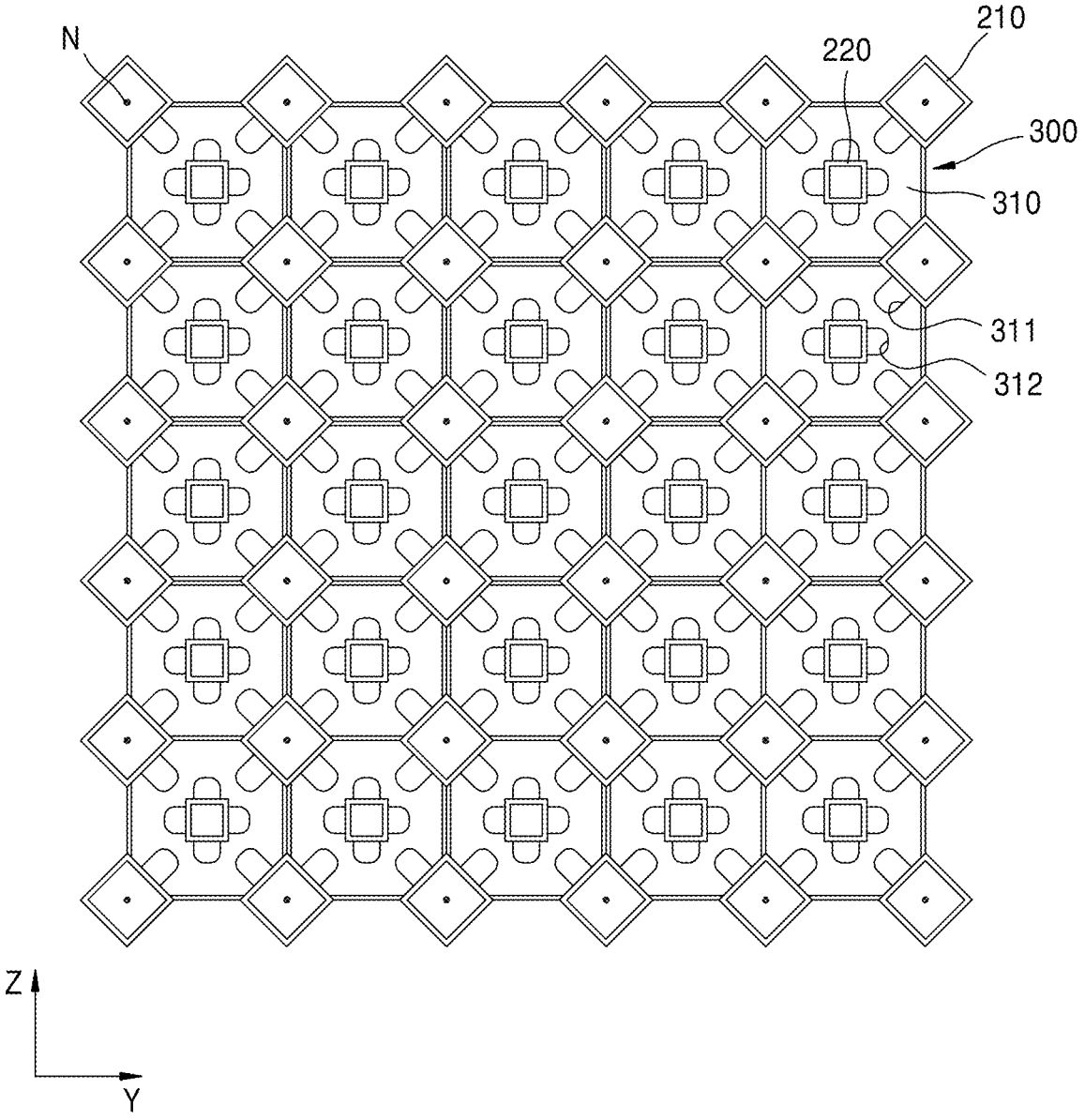
Figure 14:
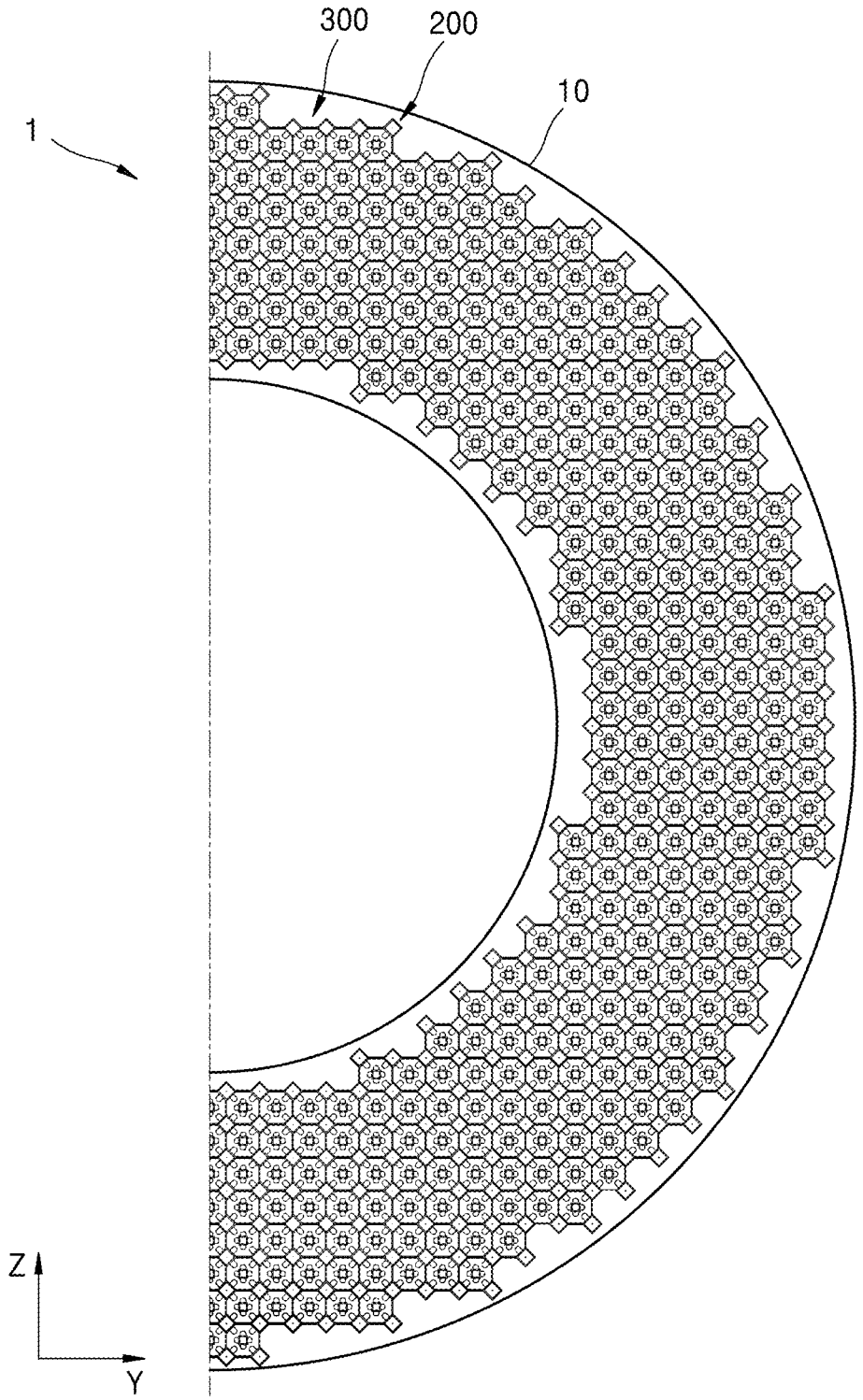
FIG. 14 illustrates a portion of a gas turbine engine including a combustion device according to an embodiment of the present disclosure.

FIG. 1 shows a gas turbine engine 1 according to an embodiment of the present disclosure, FIG. 2 shows a combustion device 10 according to an embodiment of the present disclosure, FIG. 3 is an exploded perspective view of the combustion device 10 according to an embodiment of the present disclosure, FIG. 4 is a cross-section taken along line IV-IV of FIG. 2, FIGS. 5 and 6 show a fuel distribution guide 130 and a distribution plate 140 according to an embodiment of the present disclosure, FIGS. 7, 8 and 9 show a fuel channel 200 and a combustion plate 300 according to an embodiment of the present disclosure, FIG. 10 shows a main fuel channel 210 and a main air channel 311 according to an embodiment of the present disclosure, and FIG. 11 shows a pilot fuel channel 220 and a pilot air channel 312 according to an embodiment of the present disclosure. FIGS. 12 and 13 show a fuel channel 200 and a combustion plate 300 according to an embodiment of the present disclosure, and FIG. 14 shows the gas turbine engine 1 including the combustion device 10 according to an embodiment of the present disclosure.

Referring to FIG. 1, the combustion device 10 according to an embodiment of the present disclosure may be used in the gas turbine engine 1. The gas turbine engine 1 may be an aviation gas turbine engine or a power generation gas turbine engine. The gas turbine engine 1 may be a hydrogen gas turbine engine that uses hydrogen or fuel in which liquefied natural gas and hydrogen are mixed.

As illustrated in FIG. 1, the gas turbine engine 1 may include a compressor 2, a turbine 3, a rotating shaft 4, and the combustion device 10. The air is compressed through the compressor 2 and then flows into the combustion device 10, and is combusted with fuel (e.g., hydrogen). The combustion gas flows into the turbine 3 to drive the turbine 3, and the rotation shaft 4 connected to the turbine 3 drives a load L.

Referring to FIGS. 2 through 4, the combustion device 10 according to an embodiment of the present disclosure may include a fuel manifold 100, a fuel channel 200, an air inlet duct 400, a combustion plate 300, and a combustion chamber 600.

The fuel manifold 100 receives fuel (e.g., hydrogen) from a fuel storage tank (not shown) and distributes the fuel to the fuel channel 200. As shown in FIG. 2, the fuel manifold 100 may include one or more fuel inlets 110. In more detail, the fuel inlet 110 may include a main fuel inlet 111 through which main fuel flows and a pilot fuel inlet 112 through which pilot fuel flows. That is, the combustion device 10 according to an embodiment of the present disclosure, which is a dual fuel combustion device 10, supplies only pilot fuel through the pilot fuel inlet 112 when the gas turbine engine 1 with a low flame temperature starts, and then, supplies only main fuel through the main fuel inlet 111 when the gas turbine engine 1 operates and thus the flame temperature rises. Alternatively, when the gas turbine engine 1 operates, the combustion device 10 according to an embodiment of the present disclosure supplies the pilot fuel and the main fuel together. The main fuel flowing in from the main fuel inlet 111 may be supplied to the main fuel channel 210, and the pilot fuel flowing in from the pilot fuel inlet 112 may be supplied to the pilot fuel channel 220.

According to an embodiment, the fuel manifold 100 may include a support plate 120, a fuel distribution guide 130, and a distribution plate 140.

As shown in FIGS. 2 through 5, the support plate 120 may be disposed at a front end of the combustion device 10, and one or more fuel inlets 110 may be disposed on one side of the support plate 120. The support plate 120 may be disposed to face the distribution plate 140, and the fuel distribution guide 130 may be disposed on one side of the support plate 120, so that the fuel flowing into the fuel inlet 110 may be distributed along the fuel distribution guide 130. For example, the support plate 120 may be a circular plate or a polygonal plate.

The fuel distribution guide 130 may be disposed on one side of the support plate 120, for example, at the rear thereof, and may also may be disposed on one side of the distribution plate 140, for example, at the front thereof. The fuel distribution guide 130 disposed between the support plate 120 and the distribution plate 140 may be disposed to correspond to the one or more fuel inlets 110, for example, the main fuel inlet 111 and the pilot fuel inlet 112.

According to an embodiment, as shown in FIGS. 5 and 6, the fuel distribution guide 130 may have a curved shape to guide the main fuel flowing in from the main fuel inlet 111 and the pilot fuel flowing in from the pilot fuel inlet 112 through different paths. For example, the fuel distribution guide 130 may have a shape in which a U-shape and an inverted U-shape are consecutively and repeatedly arranged. A height of the fuel distribution guide 130 may corresponds to a gap between the support plate 120 and the distribution plate 140 to prevent the fuel flowing into the fuel inlet 110 from moving beyond the fuel distribution guide 130 to another area.

According to an embodiment, the fuel distribution guide 130 may partition a plurality of fuel distribution holes 143 formed in the distribution plate 140. For example, as shown in FIGS. 5 and 6, the fuel distribution guide 130 may be arranged to separate the plurality of fuel distribution holes 143 into main fuel distribution holes **143*a* and pilot fuel distribution holes 143*b*. That is, the main fuel entering through the main fuel inlet 111 may pass through the distribution plate 140 only through the main fuel distribution hole 143*a* by the fuel distribution guide 130 and may flow into the main fuel channel 210, and the pilot fuel entering through the pilot fuel inlet 112 may pass through the distribution plate 140 only through the pilot fuel distribution hole 143*b* by the fuel distribution guide 130 and flow into the pilot fuel channel 220**.

According to an embodiment, the fuel distribution guides 130 may be provided as a pair having the same or different shapes. As shown in FIG. 6, a pair of fuel distribution guides 130 may be disposed on both sides of the distribution plate 140, more specifically, a first distribution plate 141. One fuel distribution plate 140 may be disposed between the support plate 120 and the first distribution plate 141, and the remaining fuel distribution plates 140 may be disposed between the first distribution plate 141 and a second distribution plate 142.

The distribution plate 140 may distribute the fuel flowing in through the fuel inlet 110 into different paths and supply the fuel to a plurality of fuel channels 200. For example, as shown in FIGS. 3 and 4, the distribution plate 140 may be disposed between the fuel inlets 110 and the fuel channels 200 and may include a plurality of fuel distribution holes 143.

According to an embodiment, the distribution plate 140 may include the main fuel distribution holes 143*a* and the pilot fuel distribution holes 143*b*. For example, as shown in FIG. 5, the main fuel distribution holes 143*a* and the pilot fuel distribution holes 143*b* may be arranged alternately in a plurality of rows. According to an embodiment, considering the arrangement of the fuel channels 200, a plurality of main fuel distribution holes 143*a* and a plurality of pilot fuel distribution holes 143*b* may be arranged so as not to overlap each other in a horizontal direction and a vertical direction. According to an embodiment, each main fuel distribution hole 143*a* may have a greater cross-sectional area than each pilot fuel distribution hole 143*b*.

According to an embodiment, the distribution plate 140 may include the first distribution plate 141 and the second distribution plate 142. As shown in FIGS. 3 and 4, the first distribution plate 141 and the second distribution plate 142 may be arranged in order in a fuel inflow direction. The first distribution plate 141 may face the support plate 120, and the second distribution plate 142 may be connected to the fuel channels 200. Additionally, the fuel distribution guide 130 may be disposed between the first distribution plate 141 and the second distribution plate 142.

According to an embodiment, the fuel distribution holes 143 of the first distribution plate 141 and those of the second distribution plate 142 may be different in terms of at least one of the number, a shape, and an arrangement. For example, the fuel distribution holes 143 formed in the first distribution plate 141 and the fuel distribution hole 143 formed in the second distribution plate 142 may be arranged so as not to overlap each other in the direction of movement of the fuel, and may also be provided in different numbers. In more detail, as shown in FIGS. 3 and 4, the fuel distribution holes 143 of the second distribution plate 142 may be provided to correspond to the number of fuel channels 200 and the arrangement thereof. For example, the fuel distribution holes 143 of the second distribution plate 142 may include 25 main fuel distribution holes 143*a*, and may include 16 pilot fuel distribution holes 143*b* between them. The fuel distribution holes 143 of the first distribution plate 141 may be arranged so as not to overlap the fuel distribution holes 143 of the second distribution plate 142. Accordingly, the fuel flowing into the fuel inlet 110 may be distributed more smoothly and supplied to the fuel channels 200.

The fuel channels 200 may receive fuel from the fuel manifold 100 and spray the fuel into the combustion chamber 600. Respective one ends of the plurality of fuel channels 200 may be connected to an end of the fuel manifold 100, for example, to the second distribution plate 142, and the other ends thereof may each protrude into the combustion chamber 600.

Each fuel channel 200 may have a cylindrical shape or a square pipe shape. For example, as shown in FIG. 7, each fuel channel 200 may have a square pillar or rectangular parallelepiped shape extending in the direction in which the fuel moves. Alternatively, each fuel channel 200 may have a prismatic shape of which both ends are N-polygonal or a cylindrical shape.

According to an embodiment, each fuel channel 200 may include a plurality of fuel spraying holes 230 on its lateral surface. For example, the plurality of fuel spraying holes 230 may be disposed at equal intervals on the lateral surface of an end of the fuel channel 200 protruding into the combustion chamber 600.

According to an embodiment, the fuel channel 200 may include the main fuel channel 210 and the pilot fuel channel 220.

One end of the main fuel channel 210 is connected to the main fuel distribution hole 143*a* of the distribution plate 140, and sprays the main fuel into the combustion chamber 600. The main fuel channel 210 may include one or more main fuel spraying holes 231 on its end. For example, as shown in FIGS. 7 and 10, the main fuel channel 210 may include a total of four main fuel spraying holes 231 by arranging one main fuel spraying hole 231 on each lateral surface of the other end of the main fuel channel 210 that faces the combustion chamber 600. Each main fuel spraying hole 231 may be disposed on each of the four lateral surfaces of the main fuel channel 210 to spray the main fuel. The sprayed main fuel may be burned together with air flowing in along an air channel 320 of the combustion plate 300, which will be described later.

One end of the pilot fuel channel 220 is connected to the pilot fuel distribution hole 143*b* of the distribution plate 140, and sprays the pilot fuel into the combustion chamber 600. The pilot fuel channel 220 may include one or more pilot fuel spraying holes 232 on its end. For example, as shown in FIGS. 7 and 11, the pilot fuel channel 220 may include a total of four pilot fuel spraying holes 232 by arranging one main fuel spraying hole 231 on each lateral surface of the other end of the pilot fuel channel 220 that faces the combustion chamber 600. Each pilot fuel spraying hole 232 may be disposed on each of the four lateral surfaces of the pilot fuel channel 220 to spray the pilot fuel. The sprayed pilot fuel may be burned together with air flowing in along an air channel 320 of the combustion plate 300, which will be described later.

According to an embodiment, the main fuel spraying hole 231 and the pilot fuel spraying hole 232 may have different fuel spraying angles. For example, as shown in FIGS. 7, 10, and 11, the main fuel channel 210 may be disposed such that edges on an end are inclined at predetermined angles with respect to a horizontal direction and a vertical direction (for example, a Y-axis direction and a Z-axis direction in FIG. 7). The main fuel spraying holes 231 may be disposed on the lateral surfaces of the main fuel channel 210 such that the spraying angle of the main fuel is inclined at a predetermined angle with respect to the horizontal and vertical directions. For example, the spraying angle of the main fuel may be inclined at 30 to 60 degrees, preferably, 45 degrees, with respect to the horizontal direction and the vertical direction.

The pilot fuel channel 220 may be arranged such that edges of its end are parallel to the horizontal direction and the vertical direction. The pilot fuel spraying holes 232 are disposed on the lateral surfaces of the pilot fuel channel 220, and thus the pilot fuel may be sprayed in parallel to the horizontal direction and the vertical direction.

This arrangement of the fuel spraying angle of the main fuel channel 210 and the fuel spraying angle of the pilot fuel channel 220 to form a predetermined angle may prevent flames caused by the fuel sprayed from the main fuel channel 210 and the pilot fuel channel 220 from overlapping with each other.

Additionally, the main fuel channel 210 is inclined at a predetermined angle, for example, 45 degrees, thereby minimizing flame interference between adjacent main fuel channels 210. That is, compared to a case where the main fuel channels 210 are arranged parallel to the horizontal direction and the vertical direction, a distance between fuels injected from adjacent main fuel channels 210 increases, thereby reducing an area where flames overlap. Accordingly, flame stability in various operating modes may increase, and NOx emissions may be reduced.

According to an embodiment, the pilot fuel channel 220 may be disposed between main fuel channels 210. For example, as shown in FIG. 7, the pilot fuel channel 220 may be placed at the center of four adjacent main fuel channels 210. The four adjacent main fuel channels 210 may be arranged in a square shape. Likewise, the main fuel channel 210 may be disposed between pilot fuel channels 220. The main fuel channel 210 may be disposed at the center of four adjacent main fuel channels 210 arranged in a square shape.

Through this arrangement, interference between flames sprayed from the main fuel channel 210 and the pilot fuel channel 220 may be minimized.

The number of main fuel channels 210 and the number of pilot fuel channels 220 are not particularly limited. For example, there may be 25 main fuel channels 210 and 16 pilot fuel channels 220. The plurality of main fuel channels 210 may be arranged in a square shape, and the plurality of pilot fuel channels 220 may be arranged in a square shape.

According to an embodiment, the plurality of fuel channels 200 may include different numbers of fuel spraying holes 230, respectively. For example, as shown in FIGS. 7 through 9, main fuel channels 210 disposed on the outer side among the plurality of main fuel channels 210 may include main fuel spraying holes 231 only in their inner sides, namely, only in their sides facing the pilot fuel channels 220. In detail, a main fuel channel 210 arranged at each corner may have one main fuel inlet 231, and the remaining main fuel channels 210 arranged on edges may have two main fuel inlets 231. The other main fuel channels 210 may include four main fuel spraying holes 231.

Through this configuration, the fuel inlet 230 is arranged to correspond to the air channel 310 of the combustion plate 300, which will be described later, thereby increasing combustion efficiency and suppressing combustion instability by adjusting the distribution of a flame equivalence ratio.

The combustion plate 300 is disposed between the air inlet duct 400 and the combustion chamber 600 and supports the fuel channel 200. For example, as shown in FIGS. 4 and 7, the combustion plate 300 may be arranged to support an end of the fuel channel 200 disposed inside the combustion chamber 600.

According to an embodiment, the combustion plate 300 includes the air channel 310 guiding the air introduced from the air inlet duct 400 to the fuel inlet 230 of the fuel channel 200, and burns fuel through the air channel 310. According to an embodiment, the air channel 310 may guide the air introduced from the air inlet duct 400 perpendicularly with the fuel spraying direction of the fuel spraying hole 230. That is, as shown in FIGS. 10 and 11, the air inflow direction of the air channel 310 may be an X-axis direction, and the fuel spraying angle of the fuel spraying hole 230 may be perpendicular to the air inflow direction of the air channel 310. By arranging fuel spraying channels and air inflow channels at right angles as described above, air and fuel may be mixed more smoothly, and the density of flames per unit area may be increased and also interference between adjacent flames may be minimized.

The air channel 310 may be a hole or slit formed in the combustion plate 300 to correspond to the fuel spraying hole 230 of the fuel channel 200. The air introduced through the air inlet duct 400 may be sprayed through the air channel 310 and may meet the fuel sprayed from the fuel spraying hole 230 and thus may be burnt.

According to an embodiment, the combustion plate 300 may be disposed more inward in a direction toward the fuel spraying hole 110 than the fuel spraying hole 230. In other words, as shown in FIG. 4, one end of the fuel channel 200 that includes the fuel spraying hole 230 may be disposed inside the combustion chamber 600 beyond the combustion plate 300. Accordingly, the air meets the fuel sprayed from the fuel spraying hole 230 while passing through the air channel 310 of the combustion plate 300, and thus may be burnt inside the combustion chamber 600.

According to an embodiment, the air channel 310 may be disposed to surround a plurality of fuel spraying holes 230. As shown in FIGS. 7, 10, and 11, air channels 310 may be formed in the combustion plate 300 to have one-to-one correspondence with fuel spraying holes 230. For example, a plurality of air channels 310 may be arranged in a cross shape to surround the fuel spraying holes 230.

According to an embodiment, the plurality of air channels 310 may include main air channels 311 and pilot air channels 312.

The main air channel 311 may be disposed to surround an end of the main fuel channel 210. For example, as shown in FIGS. 7 and 10, the main air channel 311 may be a hole or slit formed in the combustion plate 300 to correspond to main fuel spraying holes 231. The main air channel 311 may be formed in the same number as the number of main fuel spraying holes 231. For example, four main fuel spraying holes 231 may be formed to correspond to the four main fuel spraying holes 231 respectively formed on the four lateral surfaces of a rectangular prism. The air introduced through the main air channel 311 may be guided perpendicular to the fuel sprayed from the main fuel spraying hole 231.

According to an embodiment, the main air channels 311 may be disposed inclined at predetermined angles with respect to a horizontal direction and a vertical direction (for example, a Y-axis direction and a Z-axis direction in FIG. 8). In more detail, the main air channels 311 may be disposed at an angle of 45 degrees to the horizontal and vertical directions.

The pilot air channel 312 may be disposed to surround an end of the pilot fuel channel 220. For example, as shown in FIGS. 7 and 11, the pilot air channel 312 may be a hole or slit formed in the combustion plate 300 to correspond to pilot fuel spraying holes 232. The pilot air channel 312 may be formed in the same number as the number of pilot fuel spraying holes 232. For example, four pilot fuel spraying holes 232 may be formed to correspond to the four pilot fuel spraying holes 232 respectively formed on the four lateral surfaces of a rectangular prism. The air introduced through the pilot air channel 312 may be guided perpendicular to the fuel sprayed from the pilot fuel spraying hole 232. According to an embodiment, the pilot air channels 321 may be disposed parallel to the horizontal and vertical directions.

According to an embodiment, the combustion plate 300 may be composed of a plurality of segments 330. For example, as shown in FIG. 7, the combustion plate 300 may be arranged in plurality in a first direction (e.g., the Y-axis direction in FIG. 7) and a second direction (e.g., the Z-axis direction in FIG. 7) perpendicular to the first direction. According to an embodiment, each of the segments 330 may have a rectangular, square, diamond, parallelogram, or trapezoid shape. For convenience of explanation, a description will focus on a case where the segments 330 are squares of the same sizes and same shapes.

According to an embodiment, a plurality of main fuel channels 210 may be disposed at nodes N where the corners of the plurality of segments 330 contact each other. That is, as shown in FIGS. 8 and 9, the combustion plate 300 may have the plurality of segments 330 arranged to form a square, and may have a node N where the corners of adjacent segments 330 contact each other. A plurality of pilot fuel channels 220 may be disposed at respective centers of the segments 330.

One main air channel 311 may be formed in each of a plurality of segments 330 arranged to surround one main fuel channel 210. For example, as shown in FIG. 8, one main air channel 311 is formed in each of four adjacent segments 330 around one node N, and may be disposed to surround each main fuel spraying hole 231.

A plurality of pilot air channels 321 may be formed in one segment 330. For example, as shown in FIG. 8, four pilot air channels 321 may be formed to surround four pilot fuel channels 220 formed at the center of one segment 330.

According to an embodiment, an imaginary line extending through a plurality of main air channels 311 and an imaginary line extending through a plurality of pilot air channels 312 may intersect each other at an angle other than a right angle. For example, as shown in FIG. 8, the imaginary line extending through the plurality of pilot air channels 312 may have a square pattern arranged parallel to the Y-axis direction and the Z-axis direction. As shown in FIG. 9, the imaginary line extending through the plurality of main pilot air channels 311 may be arranged inclined at a predetermined angle, for example, 45 degrees, to the Y-axis direction and the Z-axis direction.

That is, similar to the fuel spraying holes 230, the air channels 310 may be disposed such that the main air channels 311 and the pilot air channels 312 form a predetermined angle, for example, 45 degrees. Accordingly, an area where flames formed by the fuel sprayed from the fuel spraying hole 230 and the air sprayed from the air channel 310 overlap may be minimized, and also the density of the number of flames that may be formed within the combustion plate 300 may be increased.

According to an embodiment, as shown in FIG. 8, a plurality of pilot fuel channels 220 may be arranged on an imaginary line extending through a plurality of main air channels 311. As shown in FIG. 9, a plurality of main fuel channels 210 may not be arranged on an imaginary line extending through a plurality of pilot air channels 312. This arrangement may prevent interference between the flames generated through the main fuel channel 210 and the pilot fuel channel 220, and also increase the density of the flames.

The air inlet duct 400 is disposed between the fuel manifold 100 and the combustion chamber 600 to introduce air into the combustion chamber 600. For example, the air inlet duct 400 may have a shape in which a cross-sectional area narrows from a front end to a rear end in the fuel inlet direction. A plurality of fuel channels 200 may be disposed inside the air inlet duct 400. Air may be introduced through an edge area between the fuel manifold 100 and the air inlet duct 400 and then may be uniformly distributed across the entire cross-section through the air distribution plate 500. Thereafter, air may be sprayed from an end of the air inlet duct 400 through the air channel 310 of the combustion plate 300 and burned together with the fuel.

The air distribution plate 500 is disposed inside the air inlet duct 400 and uniformly distributes introduced air. The plurality of fuel channels 200 may be arranged to pass through the air distribution plate 500. For example, a plurality of air distribution plates 500 may be arranged in the air inlet direction and may include a plurality of air distribution holes 540. The air distribution plate 500 may include channel seating holes 550 corresponding to the shapes of the fuel channels 200. Accordingly, the air distribution plate 500 may evenly distribute the air introduced into the air inlet duct 400 and also support the fuel channels 200.

According to an embodiment, the air distribution plate 500 may include a first air distribution plate 510, a second air distribution plate 520, and a third air distribution plate 530. The first air distribution plate 520, the second air distribution plate 530, and the third air distribution plate 400 may be inserted into the air inlet duct 400 sequentially in the air inlet direction.

The air flowing into an inlet of the air inlet duct 400 may be uniformly dispersed while sequentially passing through the air distribution holes 540 of the first air distribution plate 510, the second air distribution plate 520, and the third air distribution plate 530, and then may be sprayed through the air channels 310 of the combustion plate 300.

The number of air distribution plates 500 is not limited to three, and two or fewer or four or more air distribution plates 500 may be arranged.

The combustion chamber 600 is disposed at the rear of the combustion device 10, and the fuel sprayed from the fuel channel 200 and the air introduced through the air inlet duct 400 are burned. The shape of the fuel channel 600 is not limited particularly, and may have a cylindrical shape or a prismatic shape. An inlet end of the combustion chamber 600 may be connected to an outlet end of the air inlet duct 400, and a fixing plate 700 may be disposed inside the combustion chamber 600.

The fixing plate 700 is disposed inside the combustion chamber 600 to support the combustion plate 300. For example, as shown in FIGS. 3 and 4, the fixing plate 700 may be arranged to the inlet end of the combustion chamber 600, and the plurality of fuel channels 200 and the fixing plate 700 may be inserted inside the combustion chamber 600.

In the above-described embodiment, the fuel channels 200 include 25 main fuel channels 210 and 16 pilot fuel channels 220, and the combustion plate 300 is composed of 16 (4*4) segments 330 has been described. However, embodiments of the present disclosure are not limited thereto.

For example, as shown in FIG. 12, the combustion plate 300 may be composed of nine (3*3) segments 330, 16 main fuel channels 210 may be disposed at nodes N of the segments 330, and nine pilot fuel channels 220 may be disposed at respective centers of the segments 330.

Alternatively, as shown in FIG. 13, the combustion plate 300 may be composed of 25 (5*5) segments 330, 36 main fuel channels 210 may be disposed at nodes N of the segments 330, and 25 pilot fuel channels 220 may be disposed at respective centers of the segments 330.

Although not shown in the drawings, the plurality of fuel channels 200 and the combustion plate 300 are not necessarily limited to being arranged in a square shape. For example, the plurality of fuel channels 200 and the plurality of segments 330 may be arranged in a rectangle form, or the numbers of fuel channels 200 and segments 330 included in one column may be greater or less than the numbers of fuel channels 200 and segments 330 included in another column.

FIG. 14 illustrates a portion of the gas turbine engine 1 including the combustion device 10 according to an embodiment of the present disclosure.

As shown in FIG. 14, the combustion device 10 may be arranged within the gas turbine engine 1, and the plurality of fuel channels 200 and the combustion plate 300 may be arranged inside the combustion device 10. The plurality of fuel channels 200 and the combustion plate 300 may be arranged along the gas turbine engine 1 in an annular shape.

As described above, the combustion device 10 according to an embodiment of the present disclosure may modularize the number of segments 330 constituting the combustion plate 300, the arrangement of segments 330, the number of fuel channels 200, and the arrangement of the plurality of fuel channels 200 in various ways. Accordingly, the combustion device 10 is applicable to gas turbine engines 1 with various sizes, shapes, and performances, and may be quickly and easily assembled and disassembled.

In the combustion device 10 according to an embodiment of the present disclosure, the main fuel channels 210 and the pilot fuel channels 220 may be arranged to cross each other while supplying main fuel and pilot fuel separately, thereby increasing flame stability and reducing NOx emissions.

In the combustion device 10 according to an embodiment of the present disclosure, the fuel spraying angle of the main fuel channels 210 and the fuel injection angle of the pilot fuel channels 220 may cross each other, while the main fuel channels 210 and the pilot fuel channels 220 may be arranged at right angles, thereby minimizing interference between adjacent flames and increasing a flame density.

In the combustion device 10 according to an embodiment of the present disclosure, the fuel spraying angle of the fuel channels 200 and the air inlet angle of the air channels 310 may be right angles, thereby increasing combustion efficiency, minimizing interference between adjacent flames, and increasing a flame density.

The disclosure has been described above with reference to the embodiment shown in the drawings, but this is only an example. It will be understood by those skilled in the art that various modifications and equivalent other embodiments are possible from the embodiment. Therefore, the scope of the disclosure should be determined based on the accompanying claims.

Specific technical contents described in the embodiment are embodiments, and do not limit the technical scope of the embodiment. In order to concisely and clearly describe the description of the disclosure, descriptions of conventional general techniques and configurations may be omitted. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential for application of the disclosure unless the item or component is specifically described as "essential" or "critical".

In the description and claims, "above" or similar referents may refer to both the singular and the plural unless otherwise specified. Furthermore, recitation of ranges of values herein are merely intended to serve as a shorthand method of referring individually to each separate value falling within the range, unless otherwise indicated herein, and each separate value is incorporated into the specification as if it were individually recited herein. The operations that constitute a method described herein can be performed in any suitable order unless otherwise indicated herein or otherwise clearly contradicted by context. Embodiments are not limited to the described order of the operations. The use of any and all examples, or exemplary language (e.g., "such as") provided herein, is intended merely to better illuminate the disclosure and does not pose a limitation on the scope of the disclosure unless otherwise claimed. Numerous modifications and adaptations will be readily apparent to one of ordinary skill in the art in accordance with design conditions and factors without departing from the spirit and scope of the disclosure.

INDUSTRIAL APPLICABILITY

The present disclosure is usable in industries related to combustion devices.

The invention claimed is:

1. A combustion device comprising:

a fuel manifold configured to distribute fuel flowing into one or more fuel inlets;

a plurality of fuel channels configured to receive the fuel from the fuel manifold and including one or more fuel spraying holes in one end;

an air inlet duct arranged to surround the plurality of fuel channels;

a combustion plate configured to support one end of each of the plurality of fuel channels and including a plurality of air channels that guide air introduced into the air inlet duct in a direction perpendicular to a fuel spraying direction of the one or more fuel spraying holes; and a combustion chamber disposed toward the combustion plate, and wherein the one or more fuel inlets comprise:

a main fuel inlet configured to supply main fuel to a plurality of main fuel channels among the plurality of fuel channels; and a pilot fuel inlet configured to supply pilot fuel to a plurality of pilot fuel channels among the plurality of fuel channels, and wherein the combustion plate includes a plurality of segments arranged in a first direction and a second direction perpendicular to the first direction, wherein the plurality of main fuel channels are respectively disposed at nodes where corners of the plurality of segments meet each other, and wherein the plurality of pilot fuel channels are disposed at respective centers of the segments.

2. The combustion device of claim 1, wherein the one or more fuel spraying holes are disposed in a lateral surface of one end of a fuel channel among the plurality of fuel channels, and wherein the air channels are holes or slits formed in the combustion plate to correspond to the plurality of one or more fuel spraying holes, respectively.

3. The combustion device of claim 2, wherein the combustion plate is disposed more inward in a direction toward a fuel inlet among the one or more fuel inlets than a fuel spraying hole among the one or more fuel spraying holes.

4. The combustion device of claim 2, wherein the one or more fuel spraying holes are disposed in a lateral surface of the fuel channel at regular intervals, and wherein the plurality of air channels are arranged in a cross shape to correspond to the one or more fuel spraying holes.

5. The combustion device of claim 1, wherein a fuel spraying hole of a main fuel channel among a plurality of main fuel channels and a fuel spraying hole of a pilot fuel channel among a plurality of pilot fuel channels have different fuel spraying angles.

6. The combustion device of claim 1, wherein a fuel spraying hole of a main fuel channel among a plurality of main fuel channels is disposed such that a fuel spraying angle is inclined by 45 degrees with respect to a fuel spraying angle of a fuel spraying hole of a pilot fuel channel among a plurality of pilot fuel channels.

7. The combustion device of claim 1, wherein the plurality of air channels comprise:

a plurality of main air channels corresponding to the one or more fuel spraying holes of a main fuel channel among a plurality of main fuel channels; and a plurality of pilot air channels corresponding to the one or more fuel spraying holes of a pilot fuel channel among a plurality of pilot fuel channels, and an imaginary line extending through the plurality of main air channels and an imaginary line extending through the plurality of pilot air channels intersect each other at an angle other than a right angle.

8. The combustion device of claim 1, wherein the fuel manifold comprises:

one or more fuel distribution guides configured to guide main fuel flowing in from the main fuel inlet and pilot fuel flowing in from the pilot fuel inlet to different paths, respectively; and one or more distribution plates including a plurality of fuel distribution holes for supplying the main fuel and the pilot fuel distributed along a fuel distribution guide among the one or more fuel distribution guides to respective one ends of the plurality of main fuel channels and respective one ends of the plurality of pilot fuel channels.

9. The combustion device of claim 8, wherein the one or more distribution plates include a first distribution plate and a second distribution plate sequentially arranged in a movement direction of the fuel, and wherein a pair of fuel distribution guides are disposed on a front surface and a rear surface of the first distribution plate, respectively.

10. The combustion device of claim 9, wherein the plurality of fuel distribution holes included in the first distribution plate and the plurality of fuel distribution holes included in the second distribution plate are arranged so as not to overlap each other.

11. The combustion device of claim 1, further comprising one or more air distribution plates disposed inside the air inlet duct to support the plurality of fuel channels, and including a plurality of air distribution holes.

12. A combustion device comprising:

a fuel manifold configured to distribute fuel flowing into one or more fuel inlets;

a plurality of fuel channels configured to receive the fuel from the fuel manifold and including one or more fuel spraying holes in one end;

an air inlet duct arranged to surround the plurality of fuel channels;

a combustion plate configured to support one end of each of the plurality of fuel channels and including a plurality of air channels that guide air introduced into the air inlet duct in a direction perpendicular to a fuel spraying direction of the one or more fuel spraying holes; and a combustion chamber disposed toward the combustion plate, wherein the one or more fuel inlets comprise:

a main fuel inlet configured to supply main fuel to a plurality of main fuel channels among the plurality of fuel channels; and a pilot fuel inlet configured to supply pilot fuel to a plurality of pilot fuel channels among the plurality of fuel channels, wherein the plurality of air channels comprise:

a plurality of main air channels corresponding to fuel spraying holes of the main fuel channel;

a plurality of pilot air channels corresponding to fuel spraying holes of the pilot fuel channel, and an imaginary line extending through the plurality of main air channels and an imaginary line extending through the plurality of pilot air channels intersect each other at an angle other than a right angle, wherein the plurality of main fuel channels are not arranged on an imaginary line extending through the plurality of pilot air channels, and wherein the plurality of pilot fuel channels are arranged on an imaginary line extending through the plurality of main air channels.

13. A combustion device comprising:

a fuel manifold configured to distribute fuel flowing into one or more fuel inlets;

a plurality of fuel channels having a plurality of fuel spraying holes in one side,; and a combustion plate including a plurality of air channels arranged to correspond to the plurality of fuel spraying holes to support respective one ends of the plurality of fuel channels and guide air perpendicularly with a fuel spraying angle of the plurality of fuel spraying holes, and wherein the plurality of fuel channels include a plurality of pilot fuel channels supplying pilot fuel and a plurality of main fuel channels supplying main fuel, and a fuel spraying hole of the main fuel channel is disposed such that a fuel spraying angle of the fuel spraying hole is inclined at a predetermined angle with respect to a fuel spraying angle of a fuel spraying hole of the pilot fuel channel, and wherein the one or more fuel inlets comprise:

a main fuel inlet configured to supply main fuel to the plurality of main fuel channels among the plurality of fuel channels; and a pilot fuel inlet configured to supply pilot fuel to the plurality of pilot fuel channels among the plurality of fuel channels, and wherein the combustion plate includes a plurality of segments arranged in a first direction and a second direction perpendicular to the first direction, wherein the plurality of main fuel channels are respectively disposed at nodes where corners of the plurality of segments meet each other, and wherein the plurality of pilot fuel channels are disposed at respective centers of the segments.

* * * * *